United States Patent [19]

Stahlecker

[11] 4,139,162

[45] Feb. 13, 1979

[54] OPEN-END SPINNING FRAME WITH A DEVICE FOR REPLACING FULL BOBBINS WITH EMPTY TUBES

[75] Inventor: Fritz Stahlecker, Josef-Neidhart-Strasse 18, 7341 Bad Überkingen, Fed. Rep. of Germany

[73] Assignees: Fritz Stahlecker; Hans Stahlecker, both of Fed. Rep. of Germany

[21] Appl. No.: 798,470

[22] Filed: May 19, 1977

[30] Foreign Application Priority Data

Jun. 1, 1976 [DE] Fed. Rep. of Germany ..... 2624499

[51] Int. Cl.[2] ..... B65H 54/20; B65H 54/26

[52] U.S. Cl. ..... 242/35.5 A; 57/263; 57/270

[58] Field of Search ..... 242/35.5 A, 35.5 R, 242/35.6 R, 18 R, 18 DD, 41; 57/52, 53, 54

[56] References Cited

U.S. PATENT DOCUMENTS

| | | | |
|---|---|---|---|
| 3,092,340 | 6/1963 | Furst | 242/35.5 R |
| 3,640,059 | 2/1972 | Lutovsky et al. | 242/35.6 R X |
| 3,791,126 | 2/1974 | Kose et al. | 242/35.5 A X |
| 3,801,030 | 4/1974 | Kobatake et al. | 242/35.5 A X |
| 3,811,631 | 5/1974 | Mayer et al. | 242/35.5 A X |
| 3,820,730 | 6/1974 | Endo et al. | 242/35.5 R |
| 3,858,385 | 1/1975 | Shinkai et al. | 57/34 R |
| 3,940,076 | 2/1976 | Kato et al. | 242/35.5 A X |
| 3,940,077 | 2/1976 | Ohashi | 242/35.5 A |

*Primary Examiner*—Stanley N. Gilreath

*Attorney, Agent, or Firm*—Craig & Antonelli

[57] ABSTRACT

Bobbin exchange apparatus is provided for open-end spinning machines of the type having a plurality of spinning assemblies provided with respect to bobbin holders for holding bobbins to store thread. A depot device in the form of axially movable spring clamping jaws carried by a carrier rod extending along the length of the spinning machine is provided at each spinning assembly. To effect the ejection of a full bobbin from the bobbin holders and the insertion of an empty tube from the associated depot device, a mobile servicing device is provided which includes an empty tube engaging means for clampingly engaging an empty tube in the depot device and transferring the same to the bobbin holder with movement in a single plane. A bobbin holder opening device is provided at the servicing device which opens the bobbin holder to accommodate ejection of a full bobbin and insertion of an empty tube, with the bobbin holder only being opened when the empty tube engaging device is in a position on its travel path where it supports the full bobbin, so that ejection of the bobbin is supported by the same member which inserts the empty tube. Preferred embodiments include a gauge device for precisely positioning the clamping jaws at the depot devices so that the empty tubes are aligned and parallel with the bobbin holders at the respective machines to simplify the mechanical movements of the empty tube engaging jaws.

19 Claims, 8 Drawing Figures

OPEN-END SPINNING FRAME WITH A DEVICE FOR REPLACING FULL BOBBINS WITH EMPTY TUBES

BACKGROUND AND SUMMARY OF THE INVENTION

The invention relates to an open-end spinning frame with a plurality of spinning assemblies and with a travelling servicing device, movable to the respective spinning assemblies to exchange full bobbins for empty tubes. The servicing device is equipped with devices for lifting off a bobbin together with a bobbin holder from a friction roll, to open the bobbin holder and eject the bobbin, as well as with an empty tube engaging device that engages an empty tube and sets it in the bobbin holder.

In a known construction (German OS No. 2,306,907), an empty tube is ready at a place on the travelling device adjacent to the bobbin holder of the open end spinning frame. By means of a swingable lever that has an engaging roll, an empty tube is laid in, in the bobbin exchange operation, between the full bobbin and a section roll that drives the bobbin. Here the empty tube acts as a reversing drive will respect to the full bobbin, whereby part of the yarn already wound by the bobbin is again wound off and wound as yarn reserve on the empty tube. Finally, by means of an ejector, the full bobbin is transferred from its holder to a special bobbin skip. This known device for bobbin exchange entails a quite considerable expense in construction because of the multiplicity of movements that must be executed. In addition, this bobbin exchanger occupies considerable space because it has to carry along a large storage skip for empty tubes. Also, there is further expense in arranging the empty tubes at the place where they are to be dispensed.

It is also known (German Pat. No. 1,166,504) that a stationary bobbin exchanger can be disposed at each spinning assembly, each said spinning assembly being equipped with an empty-tube skip for storing its own empty tubes. The technical outlay is very high in this case also because an open-end spinning frame comprises about 200 spinning assemblies, so that there have to be 200 bobbin exchangers also.

The invention is addressed to the problem of building an open-end spinning frame and the travelling device of the mentioned type in such a way that manufacturing costs will be kept low without having to accept unfavorable operating conditions. The invention contemplates that each spinning assembly is provided with a storage place for an empty tube in the path of motion of an empty tube engaging device of the travelling device. The invention also contemplates that the empty tube engaging device effects an opening of the bobbin holder and lifting of the bobbin off of the friction roll.

In this way a semiautomatic device is developed, based on the premise that it does not require too much effort on the part of an operator to place the empty tubes manually at the individual spinning assemblies because this work is done at relatively long intervals. The necessary parts of the travelling device for execution of the work step can be limited to a minimum, particularly because the device that engages the empty tube also takes over the bobbin ejection function. In this arrangement it is preferably provided that the empty tubes already have a first winding which on the one hand serves as a yarn reserve for further processing and on the other hand is available for a starter winding, so that after bobbin exchange with a possible yarn break, yarn is present on the empty tube that allows automatic piecing. Here it is also preferably provided that there will be a planned interruption of the spinning process in the bobbin exchange, especially if it is provided that a cleaning of the spinning assembly will be done with an exchange of bobbins. In this case it can be provided that the travelling device will be a component of a cleaning device or will be combined with a travelling cleaning device in some other way.

In an advantageous embodiment of the invention, the depot devices with the empty tubes are provided with axially fixed stops that are oriented to the bobbin holder of the appurtenant spinning assembly in such a way that the empty tubes are held in a position that is parallel to their position of incorporation in the bobbin holder. We thus have the advantage that the work of setting up and positioning the empty tubes need not be done by the travelling device, so that the empty tube engaging device of the travelling device only has to execute a simple motion in one plane.

In one embodiment of the invention it is provided that the depot devices for empty tubes are disposed at each spinning assembly on a piece on the bobbin holder. Thus the path that the empty tube has to negotiate to its position of incorporation in the bobbin holder is very short. The empty tube engaging device can then be correspondingly simple.

In another embodiment of the invention it is provided that the depot devices for the empty tubes for the spinning assemblies are disposed on a carrier rod running in the long direction of the machine. This type of arrangement of the depot devices allows simple operation because the depot devices are readily accessible. It is also possible to orient the depot devices on the carrier rod in a simple way, exactly to the bobbin holder of the appurtenant spinning assembly and to the empty tube engaging device of the travelling device.

In an advantageous embodiment of the invention it is provided that the device that engages the empty tubes is equipped with spring tongs that grip an empty tube, in which tongs an empty tube can be clipped in at its periphery, and can be removed from the stationarily disposed depot device. With this embodiment the former customary relatively expensive gripping devices with their drives can be replaced without difficulties in function.

These and other objects, features and advantages of the present invention will become more apparent from the following description when taken in connection with the accompanying drawings, which show, for purposes of illustration only, several embodiments in accordance with the present invention.

DETAILED DESCRIPTION OF THE DRAWINGS

Figure 1:
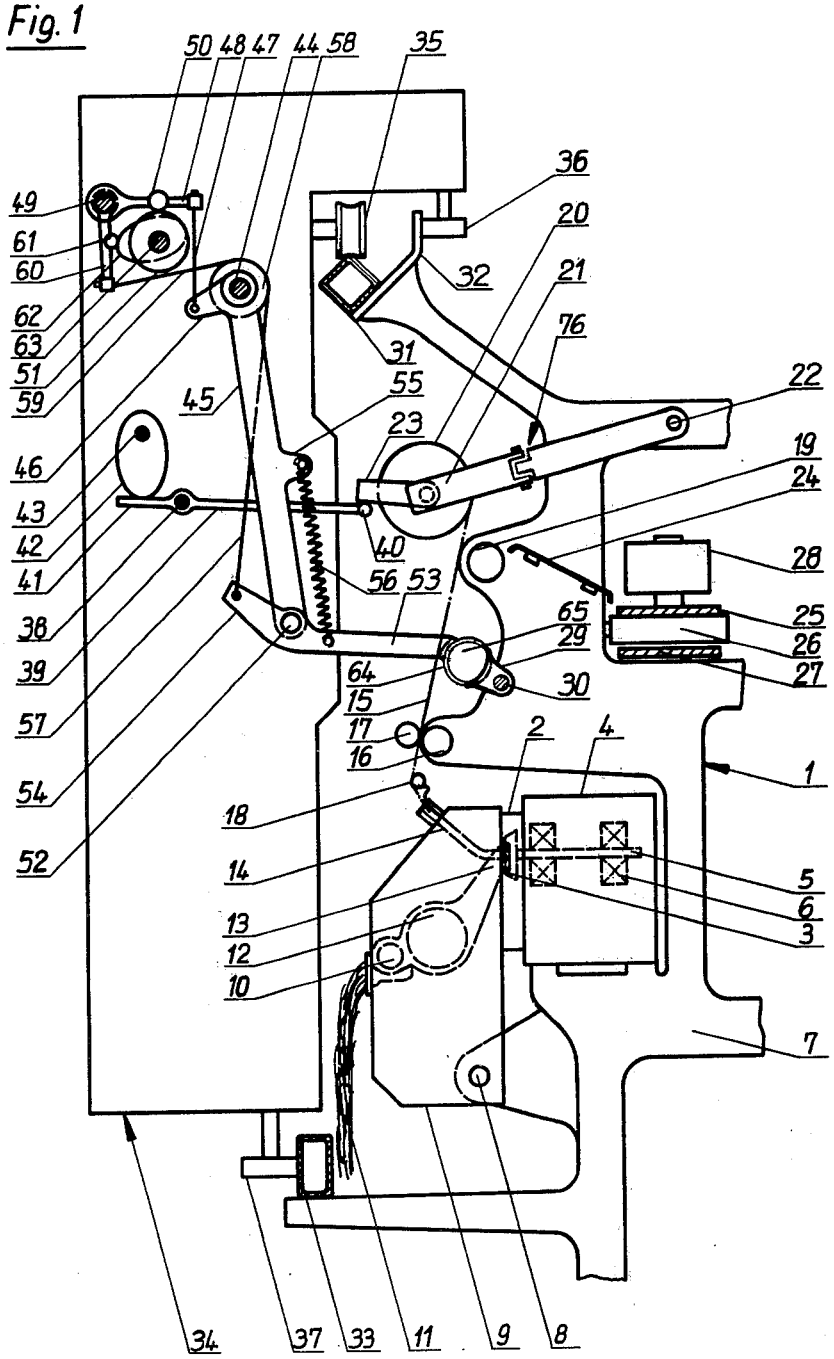
FIG. 1 is a cross sectional schematic view through a spinning assembly of an open-end spinning frame with a travelling device for execution of a bobbin exchange constructed in accordance with a preferred embodiment of the invention, showing the travelling device in a first work stage position.

The spinning assembly 1 of FIG. 1 of an open-end spinning frame constituted by a plurality of such spinning assemblies presents among other things a vacuum housing 2 for acceptance of a spinning rotor 3, a bearing housing 4 fixed on the machine frame 7 to accept the rotor shaft 5 in bearings 6, as well as a housing 9 swingable about a stationary shaft 8 to accept a feed roll 10 for the sliver 11 that is to be spun, as well as a fast running opener roll 12 which opens the supplied sliver 11 into individual fibers. These fibers are delivered in a known way via a feed passage 13 to spinning rotor 3 and from there they are drawn off as spun yarn 15, indicated by dot and dash lines, from a corresponding yarn take off passage 14, with intermediate connection of a yarn monitor 18 via take off rolls 16, 17. Spun yarn 15 in the operating state is wound on a bobbin 20, driven by a friction roll 19 fixed on the machine. During an exchange of bobbins, i.e. the exchange of a full bobbin for an empty tube, the winding device which is designated as a whole by numeral 76 is lifted from friction roll 19, by way of a bobbin holder 21 that is swingable about shaft 22 that is fixed on the machine. To release the full bobbin 20 from bobbin holder 21, an arm 23 can be spread (moved in a direction perpendicular to the FIG. 1 plane), whereupon, in a way yet to be described, bobbin 20 is pushed onto a slide plate 24 and transferred to a conveyor belt 25 in the middle of the machine (only the left half of the machine being illustrated, a similar set of assemblies being disposed on the right half and facing oppositely of the illustrated assembly 1. Conveyor belt 25, whereof the(return)running portion 27 is also to be seen, runs on guide rolls 26 and accepts the full bobbins 28 on its front side. In the region of slide plate 24 there may be auxiliary means (not shown) ensuring that the bobbins 28 will assume the illustrated position on belt 25.

Below winding device 76 there is a depot device 29 for an empty tube 65. Depot device 29 is disposed on a carrier rod 30 that extends in the long direction of the machine. This depot device 29 is adjustable in the long direction of the machine, in a way that will be explained in detail later. An empty tube 65 is placed in preparation manually on each spinning assembly 1.

There are rails 31, 32 and 33 disposed to run in the long direction of the open-end spinning frame, on which by means of wheels 35, 36 and 37 a travelling device 34 can be moved, for exchanging full bobbins for empty tubes. A double lever 39 is swingable about a shaft 38 of device 34. On one end of this lever 39, arm 23 of winding device 76 can be lifted off by means of a cam 40 or the like. At the other end, a rotatable curve plate 42 that rotates about shaft 43 acts as a drive mechanism engaging lever arm 41. In preferred embodiments, the spinning process would be interrupted during the actual bobbin exchange process, so that the yarn course 15 as indicated by dot and dash lines would not be there.

A lever 45 is swingable about another shaft 44 of travelling device 34, its swing motion being triggered by a tension strip 47 or the like disposed on an extension 46 of the lever 45. Tension strip 47 is fixed to a lever arm 48 that is swingable about a shaft 49 and that presents a guide surface 50 against which a curve plate 51 driven about a shaft 63 runs. The movement of rotation of curve plate 51 effects a corresponding pivotal motion of lever 45 about shaft 44. At the lower end of lever 45 there is a pin 52 about which a double lever 53, 54 is swingable. Arm 53 of this double lever is held on the one hand by a tension spring 56 located on an extension 55 of lever 45, while on the other hand, arm 54 of the double lever is urged by a tension strip 57. Said tension strip 57 is applied around a roll 58 that is rotatable about shaft 44 and fixed with its other end 59 to a lever 60 which is pivotal about the shaft 49 and presents a guide surface 61 against which there is applied a curve plate 62 that is rotatable about shaft 63. Curve plate 62 allows and controls a swinging motion of double lever 53, 54 about pin 52. On arm 53 of the double lever there are provided spring tongs 64 for engaging the presented empty tube 65, which tongs engage and hold the empty tube, with elastic spreading. Arm 53 of the double lever thus serves as an engaging device for the empty tube 65.

Figure 2:
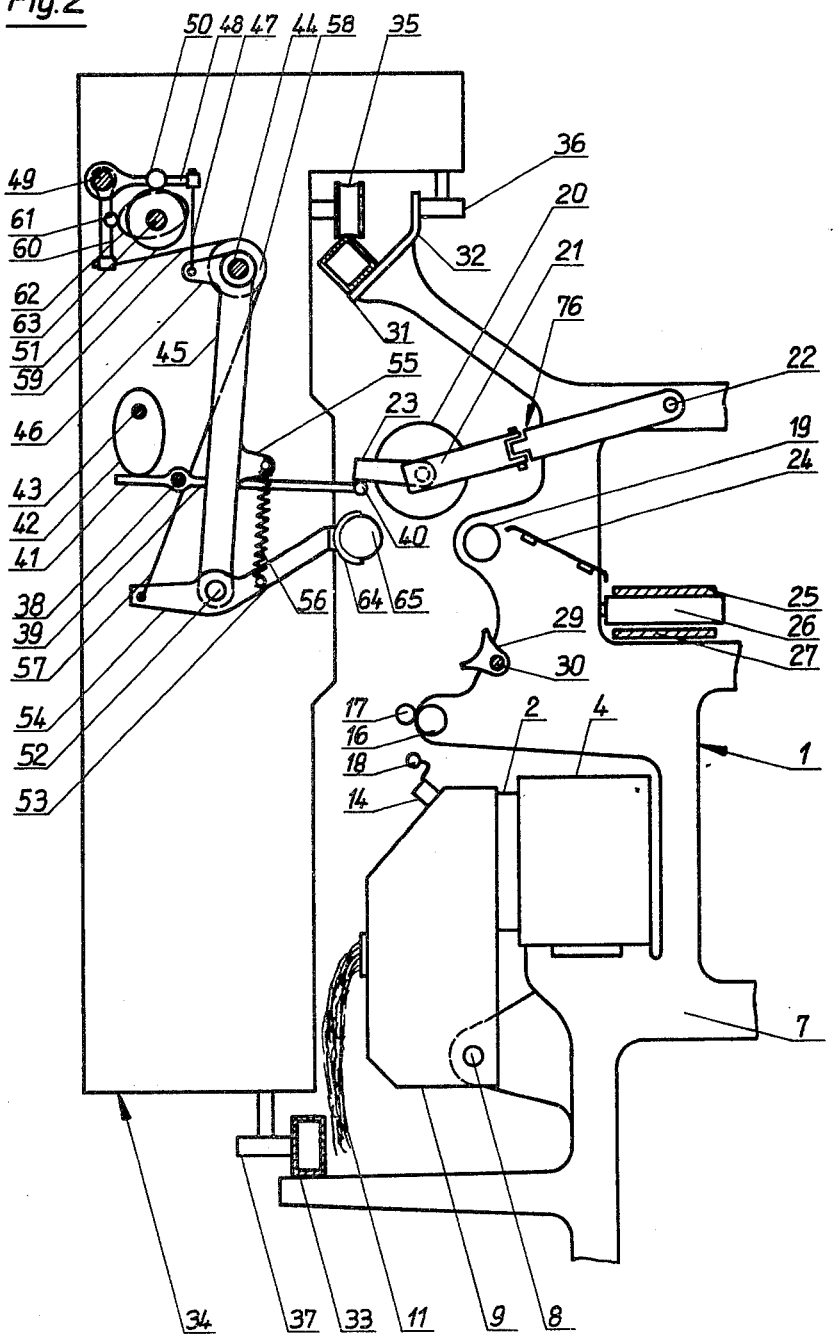
FIG. 2 is a view similar to FIG. 1 showing the travelling device in a later work stage position.
Figure 3:
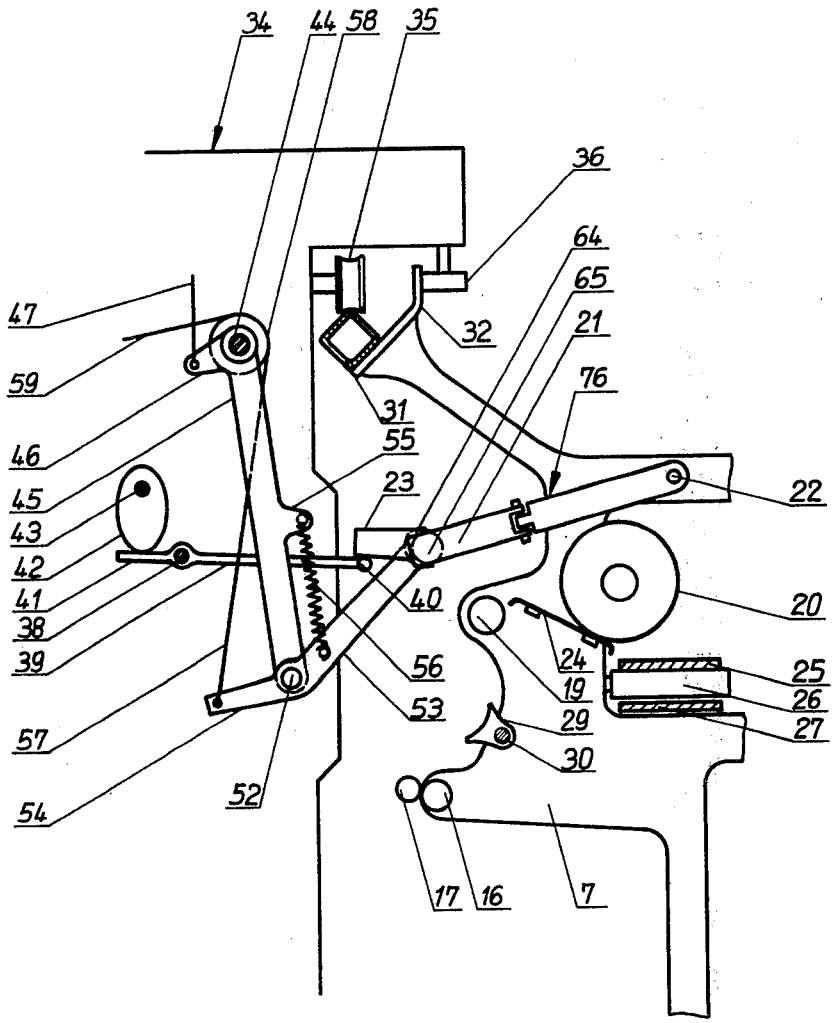
FIG. 3 is a partial sectional view showing a still later work stage.

Acted on by curve plates 51 and 62, empty tube engaging device 53 can be guided to an empty tube 65 placed in empty tube depot device 29, where it engages the empty tube 65 with spring tongs 64 and brings the empty tube 65 to bobbin 20 as illustrated in FIG. 2. The relative position of levers 45 and 53 is the only change in FIG. 2 as compared to FIG. 1. Empty tube engaging device 53 then presses empty tube 65 against full bobbin 20, whereby the full bobbin 20 is forced out of holder 21 onto slide plate 24, as illustrated in FIG. 3. FIG. 3 shows a section in a somewhat later operating position; at that moment when empty tube 65 is set into bobbin holder 21 by empty tube engaging device 53. Since the device 53 at the same time forces full bobbin 20 out of the bobbin holder and depot device 29 is in the immediate vicinity of winding device 76, there is a great simplification in manufacture of travelling device 34. Bobbin holder 21 is only opened if empty tube engaging device 53 is applied to bobbin 20, so that the bobbin 20 is supported by said engaging device 53 or by empty tube 65, respectively. The subsequent movement of empty tube engaging device 53 is so directed that bobbin 20 that is moved out of holder 21 receives a motion component toward slide plate 24, i.e. radially to the pin of bobbin holder 21 and obliquely with reference to slide plate 24. Empty tube engaging device 53 is thereby set under bobbin 20 so that it supports it. Bobbin holder 21 has two pins, indicated only by dashed lines, that penetrate into the open front faces of empty tube 65. By swinging of arm 23, bobbin holder 21 can be spread in such a way that the pins move away from each other and bobbin 20 is released and the pins are ready to receive an empty tube 65. This spreading can be effected, for example, by a further movement of arm 23 where bobbin holder 21 is applied to a stop.

Curve plates 42, 51 and 62 that cause the movements are moved in a mutual relationship to accomplish the described sequential stages of bobbin transfer. For this there is preferably a common drive that turns the curve plates by means of a gearing that is not illustrated, so that precisely adjusted mutual movements are ensured. In some contemplated arrangements it is also provided that the empty tube engaging device 53 has a piece engageable with arm 23 of bobbin holder 21 that then takes over the spreading of bobbin holder 21. In this case there does not have to be a precise adjustment with the drive of lever 39. Other embodiments are also contemplated wherein each spinning assembly is furnished with a lift off device for bobbin holder 21, controlled by a monitoring device that determines the degree of filling of bobbins 20, so that when there is a full bobbin the bobbin holder 21 will automatically be lifted off. In this case it would be possible to do without lever 39, or this lever would only effect the opening of bobbin holder 21.

Figure 4:
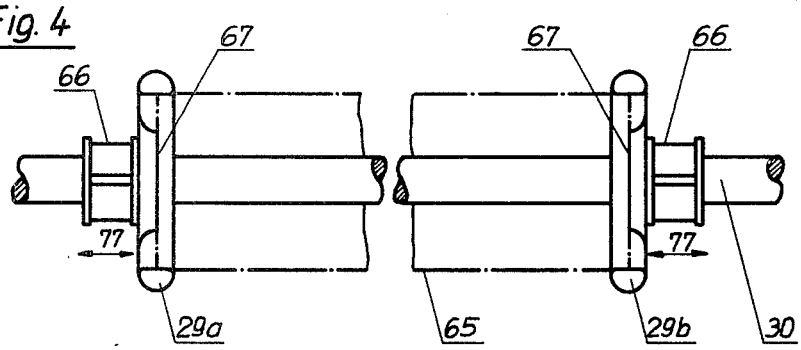
FIG. 4 is a partial view of a detail of the spinning assembly of FIGS. 1 to 3, taken in the radial direction of the tube 65 illustrated in FIG. 1.
Figure 5:
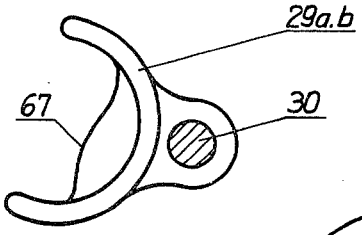
FIG. 5 is a cross sectional view of the detail of FIG. 4.

FIG. 4 shows how depot device 29, comprising two clamping jaws *29a* and *29b*, is disposed on carrier rod 30 that runs in the long direction of the machine. The distance between jaws *29a* and *29b* is so adjusted, that the empty tube 65 that is to be presented can be applied with its front ends against axial stops 67 (see also FIG. 5). This allows precise fixed positioning of tube 65 within depot device 29. Jaws *29a, 29b* can be precisely set and fixed in the direction of the double arrow 77 on carrier rod 30 by means of a clamping device 66 which is made of plastic. Jaws *29a, 29b* have a somewhat semicircular configuration and hold the edge of empty tube 65 with light spring force, i.e. the tubes are lightly clipped in when they are laid in the depot device. The retaining force of the spring tongs which are of similar configuration and engage empty tube 65 in the middle is substantially greater, so that spring tongs 64 can reliably withdraw the empty tube from clamping jaws *29a, 29b*. The semicircular or half ring-shaped jaws *29a, 29b* are so directed with reference to empty tube engaging device 53 that the empty tube that is held by them is adequately supported so that the spring tongs 64 oppose an adequate supporting force.

Figure 6:
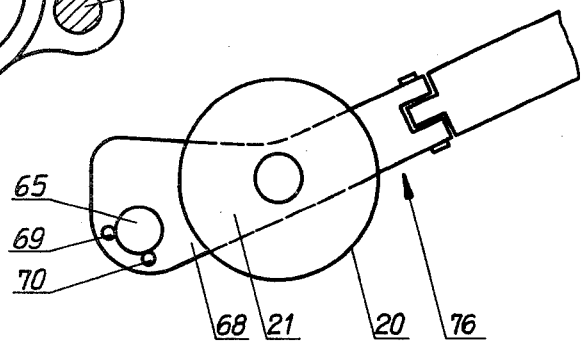
FIG. 6 is a detail view of another embodiment of a depot device of a spinning assembly of an open-end spinning frame taken in the axial direction of the full bobbin tube 20.

FIG. 6 shows a portion of a winding device 76, whose bobbin holder 21 presents an extension 68 on which adjustable receiving devices 69, 70 are disposed, that constitute a depot device for an empty tube 65 that is to be presented. According to FIG. 7 there may also be resilient receiving devices 73, 74 on a corresponding extension 72 on bobbin holder 21. The mentioned lever 39 of bobbin exchanging device 34 can press against the other extension 71 of bobbin holder 21 and thus lift the full bobbin 20 from friction roll 19.

Figure 7:
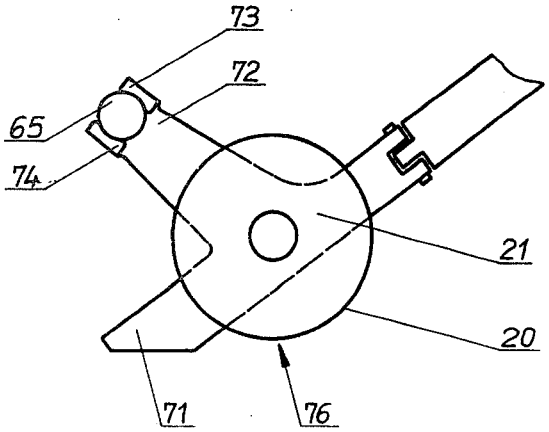
FIG. 7 is a view similar to that of FIG. 6 showing another embodiment.
Figure 6A:
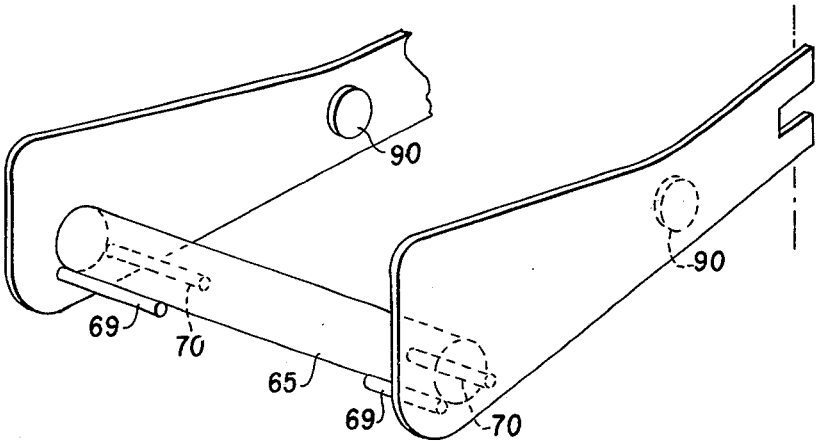
FIG. 6A is a schematic perspective view showing the combined depot device and bobbin holder assembly of FIG. 6.
Figure 7A:
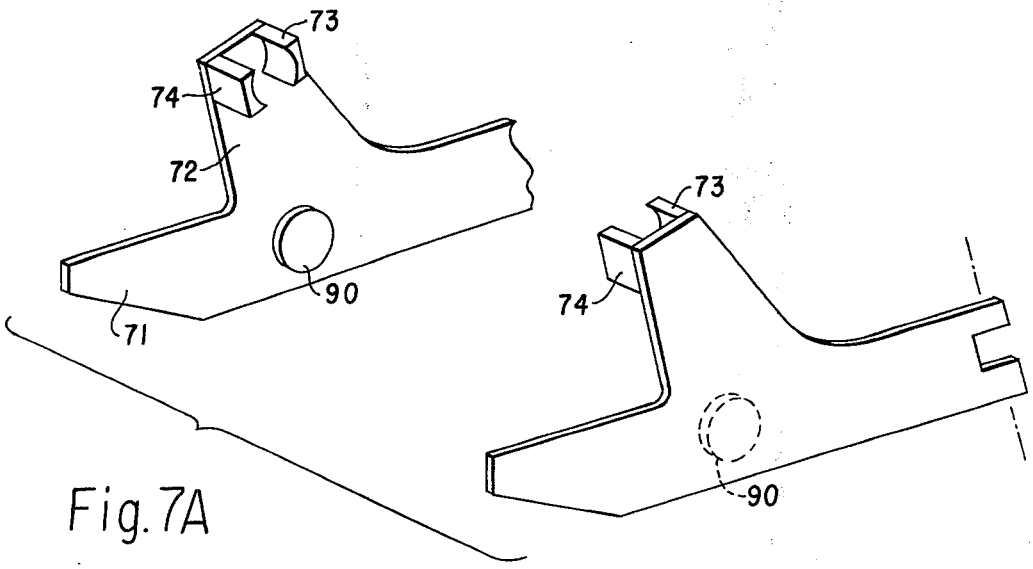
FIG. 7A is a schematic perspective view showing the combined depot device and bobbin holder assembly of FIG. 7.

FIGS. 6A and 7A schematically depict the spool holders of FIGS. 6 and 7 respectively, with pins 90 for holding the tube during spinning operations. In order to bring the empty tubes 65 to pins 90, a device corresponding to arm 53 and tongues 64 of the embodiment of FIGS. 1 and 2 is provided which engages the empty spool tube 65 after the spool holder has been lifted off the winding roll by the lever 39 (see FIG. 1). When the empty tube 65 has been grasped, the spool holder is also opened by means of the lever 39 (see FIG. 1), whereby at the same time the grasping device with the empty tube 65 is moved toward the pins 90 which heretofore held the full spool 20, thereby forcing the full spool 20 out of the spool holder. The grasping device then leads the empty tube 65 into the region of pins 90, whereafter the spool holder is again closed via lever 39 so that the pins 90 receive the empty tube, after which the grasping device is moved back (see the FIG. 1 illustration and description of the operation of this lever 39).

Figure 8:
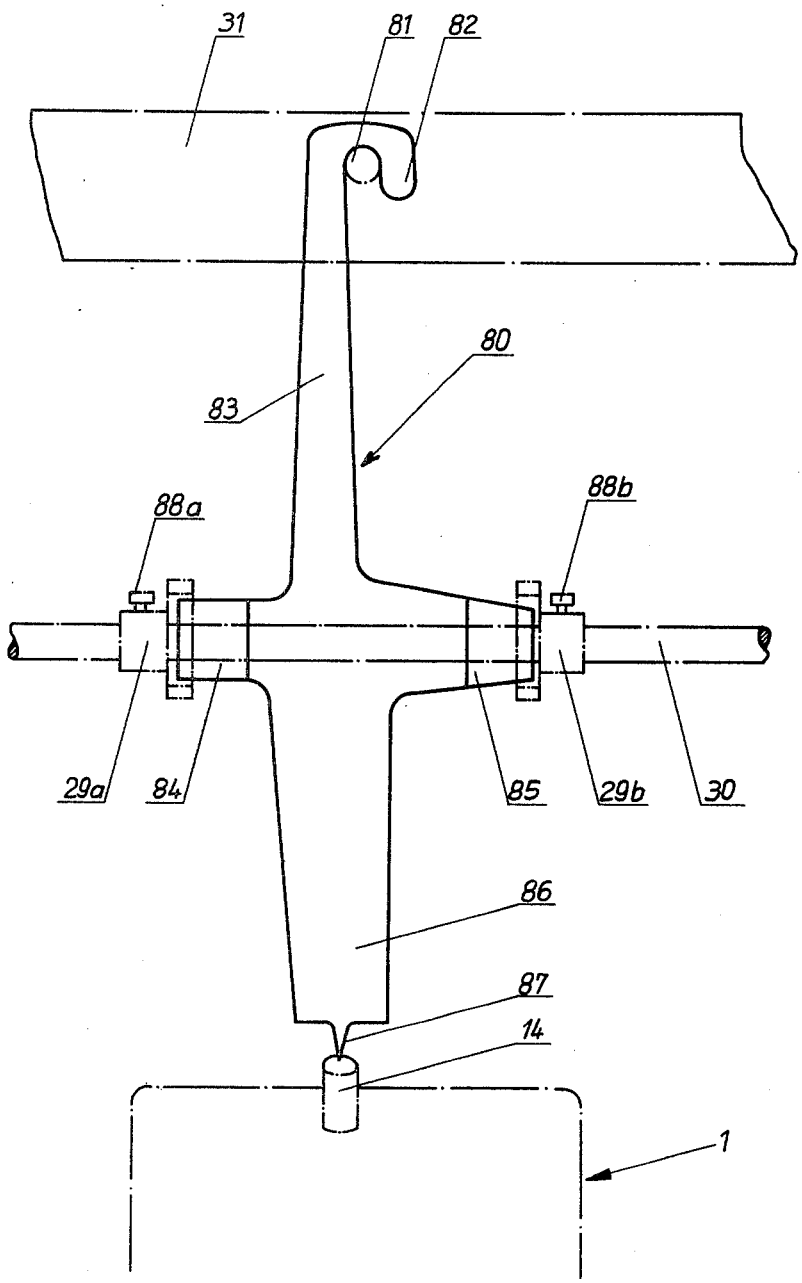
FIG. 8 shows a setting gauge for adjusting and orienting the depot device for the empty tubes on a spinning assembly, taken in the radial direction of the axle 30 shown in FIG. 1.

FIG. 8 shows an arrangement, whereby with use of a setting gauge 80, the two jaws *29a, 29b* can be adjusted with respect to their direction orientation, position along rod 30 and their spacing from one another. For this, the setting gauge 80 that presents two arms 83 and 86 is suspendable by a hook 82, an eye or the like on an indexing pin 81 of rail 31. Index pin 81 is precisely adapted to the spinning assembly 1 in question for giving the command to the servicing device 34, for correctly positioned halting at a spinning assembly that requires servicing. The structural elements that do not belong to setting gauge 80 are drawn with dot and dash lines in FIG. 8. Lower arm 86 of gauge 80 is long enough, so that it reaches with its pointer 87 to the opening of yarn take off conduit 14 of spinning assembly 1. In this way there can be a precisely determined position of gauge 80 maintained at any individual spinning assembly. Of course other setting possibilities are conceivable according to the invention. The two lateral, advantageously cylindrical arms 84 and 85 of gauge 80 define with their outer separation precisely the length and direction to the periphery of carrier rod 30 of an empty tube that is later to be held at this point. Arms 84 and 85 act in the setting process as a stop for the two jaws *29a, 29 b* which can be fixed by screws *88a, 88b* on rod 30. The open sides of the jaws will be so directed by turning on rod 30 that they point in the movement direction of tongs 64 of the empty tube assembly 53.

While we have shown and described only several embodiments in accordance with the present invention, it is understood that the same is not limited thereto but is susceptible of numerous changes and modifications as would be known to those skilled in the art, given the present disclosure, we therefore do not wish to be limited to the details shown and described herein but intend to cover all such changes and modifications as are encompassed by the scope of the appended claims.

I claim:

1. Bobbin exchange apparatus for open-end spinning machines and the like of the type having a plurality of spinning assemblies provided with respective bobbin holders for holding bobbins to store thread produced at the spinning assembly; said apparatus comprising:

a depot device for storing an empty tube at a spinning assembly, an empty tube engaging means for engaging an empty tube in said depot device, guide means for guiding said tube engaging means with the empty tube engaged thereby to the bobbin holder at said spinning assembly, and bobbin holder opening means for opening said bobbin holder to accommodate removal of a full bobbin and insertion of an empty tube carried by said empty tube engaging means, said bobbin holder opening means including means for opening said bobbin holder when said empty tube engaging means is in a position for one of said empty tube engaging means and said empty tube carried thereby to at least partially support a full bobbin in said bobbin holder.

2. Apparatus according to claim 1, further comprising a mobile servicing device which is selectively movable to respective servicing positions adjacent each of a plurality of spinning assemblies, wherein a depot device is provided adjacent each spinning assembly for storing an empty tube, and wherein said empty tube engaging means, said guide means, and said bobbin holder opening means are carried by said mobile servicing device.

3. Apparatus according to claim 2, wherein said bobbin holder opening means includes means for opening said bobbin holder only when said empty tube engaging means is in a position for supporting a bobbin in said bobbin holder.

4. Apparatus according to claim 3, wherein the empty tube engaging means is equipped with spring tongs engageable directly with the periphery of an empty tube to clip the same while in said depot device.

5. Apparatus according to claim 3, wherein each of said depot devices is provided with stops that axially position the empty tubes, said stops being disposed with reference to the bobbin holder at the respective spinning assembly in such a way that the empty tube is held in a position parallel to the position of its incorporation in the bobbin holder.

6. Apparatus according to claim 5, wherein the empty tube engaging means is equipped with spring tongs engageable directly with the periphery of an empty tube to clip the same while in said depot device.

7. Apparatus according to claim 5, further comprising a gauge device for accurately positioning said stops, said gauge device including a first part attachable to an index pin for a spinning assembly and a second part alignable with a thread outlet of said spinning assembly.

8. Apparatus according to claim 3, wherein the depot devices are disposed at each respective spinning assembly on portions of the respective bobbin holders.

9. Apparatus according to claim 8, wherein said portion of the bobbin holders are movable to accommodate opening of the bobbin holders.

10. Apparatus according to claim 3, wherein the depot devices are disposed on a carrier rod running in the longitudinal direction of the spinning machine.

11. Apparatus according to claim 10, wherein each of said depot devices is formed with two jaws for accepting the frontal faces of the empty tubes.

12. Apparatus according to claim 11, wherein said jaws are displaceably attached to said carrier rod, and wherein tensioning means are provided for fixing said jaws in axial position at said carrier rod.

13. Apparatus according to claim 12, wherein the jaws are made as spring clamps that partly enclose the edges of an empty tube.

14. Apparatus according to claim 13, wherein the empty tube engaging means is equipped with spring tongs engageable directly with the periphery of an empty tube to clip the same while in said depot device, and wherein said jaws engage said empty tube at positions spaced from the engagement of said spring tongs with said empty tube.

15. Apparatus according to claim 11, wherein the jaws are made as spring clamps that partly enclose the edges of an empty tube.

16. Apparatus according to claim 3, wherein said bobbin holder opening means includes means for opening said bobbin holder when said empty tube engaging means is in a position for directly supporting a full bobbin in said bobbin holder while said tube engaging means is moving an empty tube into position in said bobbin holder.

17. Apparatus according to claim 1, wherein the depot device is disposed on a portion of the bobbin holder.

18. Apparatus according to claim 17, wherein said portion of the bobbin holder is movable to accommodate opening of the bobbin holder.

19. Apparatus according to claim 1, wherein each of said depot devices is provided with stops that axially position the empty tubes, said stops being disposed with reference to the bobbin holder at the respective spinning assembly in such a way that the empty tube is held in a position parallel to the position of its incorporation in the bobbin holder.

* * * * *